United States Patent [19]

Pigford et al.

[11] 4,315,362

[45] Feb. 16, 1982

[54] METHOD AND TOOL FOR PLACING BEADS ON A BRAID OF HAIR

[76] Inventors: James W. Pigford; Carolyn J. Green, both of 367 N. Maple, Ann Arbor, Mich. 48103

[21] Appl. No.: 172,711

[22] Filed: Jul. 28, 1980

[51] Int. Cl.[3] ..... B23P 19/04

[52] U.S. Cl. ..... 29/433; 29/241; 63/2; 132/38 R; 132/46 R; 163/5

[58] Field of Search ..... 29/433, 241; 163/2, 163/5; 132/9, 46 R, 38 R, 53, 56, 38 A; 63/2

[56] References Cited

U.S. PATENT DOCUMENTS

| | | | |
|---|---|---|---|
| 602,699 | 4/1898 | Davis | 132/46 R |
| 2,063,918 | 12/1936 | Flood | 29/433 UX |
| 2,064,826 | 12/1936 | Gabriel | 29/433 X |
| 2,924,228 | 2/1960 | McGee | 132/46 R |
| 3,035,817 | 5/1962 | Wilson | 29/433 UX |
| 3,133,345 | 5/1964 | Shaw | 29/433 |
| 3,196,064 | 7/1965 | Tell | 29/433 X |
| 3,227,121 | 1/1966 | Speetjens et al. | 163/5 X |
| 3,450,140 | 6/1969 | Vail | 132/9 |
| 3,545,069 | 12/1970 | Krieger | 29/433 |

FOREIGN PATENT DOCUMENTS

| | | | |
|---|---|---|---|
| 2390118 | 1/1979 | France | 132/53 |

*Primary Examiner*—Charlie T. Moon

*Attorney, Agent, or Firm*—Charles W. Chandler

[57] ABSTRACT

A method and tool is disclosed for placing a series of beads on a braid of hair in which the braid is received through a loop formed of a cord on which the beads have been strung, the beads then being pushed onto the braid which is then removed from the loop.

5 Claims, 6 Drawing Figures

METHOD AND TOOL FOR PLACING BEADS ON A BRAID OF HAIR

BACKGROUND OF THE INVENTION

This invention is related to a method for quickly and easily placing beads onto braided hair, employing a tool for sliding beads onto a braid of hair.

Many people presently form their hair into a series of long thin braids. A popular practice is to place beads onto the braids by stringing the beads on a loop formed of either string or a hair pin, passing the braid through the loop, and then pushing the beads onto the braid. However, string is difficult to use because of its high degree of flexibility while a hair pin is difficult to use because of its high degree of stiffness. Either process involves a time consuming procedure when several beads are being placed on several braids.

SUMMARY OF THE INVENTION

The broad purpose of the present invention is to provide a method and a tool for placing a series of beads on a braid of hair and more particularly to a method employing a beader formed of a plastic coated wire cord that is folded in half to form a loop with an elbow. Several beads are strung onto the looped wire cord. The braid of hair is then passed through the loop and the beads pushed onto the braid. The braid is then removed from the loop so that the process can be repeated on the other braids.

A plastic coated wire cord provides several special advantages over the use of a looped string or a hair pin, because it has both the flexibility to easily receive a braid of hair of different sizes, but also the stiffness to easily string the beads.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 5:
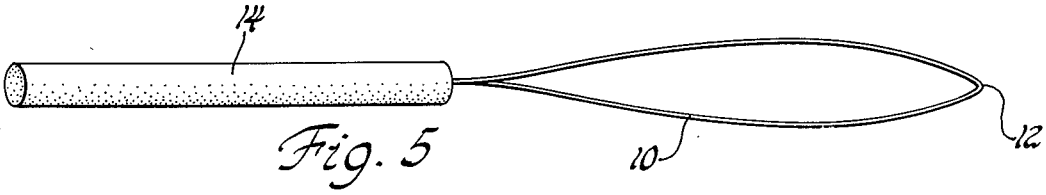
FIG. 5 is a view of a preferred tool.

Referring to the drawing, FIG. 5 illustrates a preferred beader comprising an elongated wire cord 10 bent in half to form a permanent elbow 12 having an acute angle suited for passing through the opening in a bead. A handle 14 is connected to the ends of cord 10.

Figure 6:
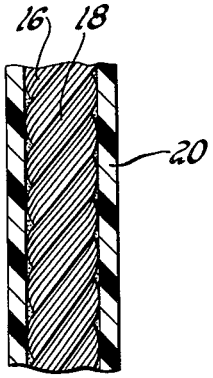
FIG. 6 is an enlarged sectional view of a portion of the wire cord.

Referring to FIG. 6, the wire cord is formed of metal wires 16 and 18 twisted to form a resilient cord. A plastic coating 20 covers the metal wires the full length of the cord in such a manner that the cord is uniformly resilient along its full length.

The cord is adapted to form a thin, very resilient loop to accomodate braids of a wide range of diameters.

Figure 2:
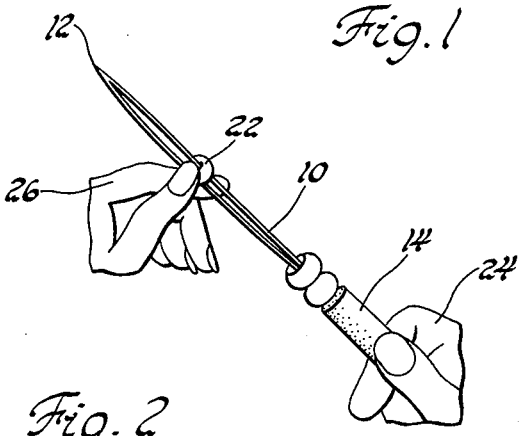
FIGS. 2 to 4 illustrate the sequence of steps employed in the preferred method.
Figure 3:
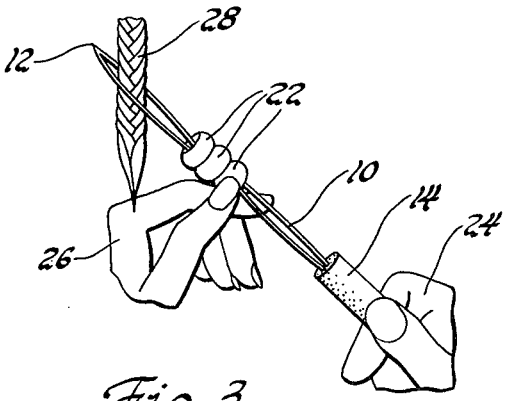
Figure 4:
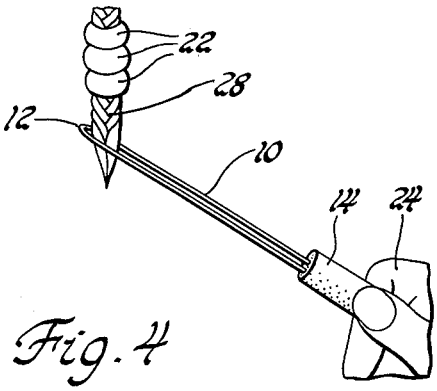

Referring to FIGS. 2, 3, and 4, the preferred method comprises stringing a series of beads 22 onto the wire cord by passing the elbow through the center opening of each of the beads. Normally the user employs one hand 24 to hold the beader handle while his other hand 26 strings the beads onto the wire cord.

Figure 1:
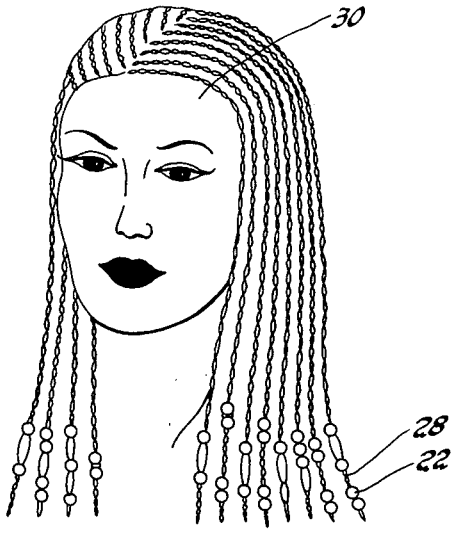
FIG. 1 illustrates a user having her hair braided, each braid supporting several beads placed thereon in accordance with the preferred method.

A braid of hair 28 is then passed through the loop between elbow 12 and beads 22. The beads are then pushed along the wire cord and onto the braid which is folded in half about elbow 12, and then along the two braid halves until the beads pass the lower end of the braid. The user then removes the braid from the loop to give the effect illustrated in FIG. 1 in which the braid is mounted on the head 30 of the user. He then repeats the process on other braids in a similar manner. The process can be easily repeated on a large number of braids to position several beads of various colors on each braid more easily and quicker than the conventional process of attempting to pass the braid end directly through the opening on each individual bead or using a looped string or hair pin an an aid.

Having described my invention, I claim:

1. A method for placing a bead on a braid of hair, comprising the steps of:

folding a stranded metal flexible wire cord so as to form a pair of resilient cord halves connected by an acute angle permanently bent elbow;

passing the elbow through the opening of a bead;

passing the braid through the two halves of the wire cord between the elbow and the bead;

pushing the bead onto the braid; and removing the braid from between the two wire cord halves.

2. A method as defined in claim 1, in which the elbow of the wire cord is passed through the openings of a plurality of beads and the plurality of beads are pushed onto the braid.

3. A method as defined in claim 1, including a handle attached to the ends of the wire cord.

4. A method as defined in claim 1, in which the wire cord has a plastic coating.

5. A beader device, comprising:

an elongated metal wire cord comprising strands of wire twisted together such that the cord is laterally uniformly resilient along its full length;

a plastic coating disposed the full length of the wire cord;

the cord being bent in half to form a permanent acute angle elbow such that the ends of the cord are adjacent one another; and a handle connected to the adjacent ends of the cord.

* * * * *